US005741163A

United States Patent [19]

Hotea

[11] Patent Number: 5,741,163

[45] Date of Patent: Apr. 21, 1998

[54] ELECTRICAL RECEPTACLE TERMINAL

[75] Inventor: Gheorghe Hotea, Griesheim, Germany

[73] Assignee: The Whitaker Corporation, Wilmington, Del.

[21] Appl. No.: 677,553

[22] Filed: Jul. 11, 1996

[30] Foreign Application Priority Data

Jul. 26, 1995 [GB] United Kingdom ..... 9516408

[51] Int. Cl.[6] ..... H01R 11/22

[52] U.S. Cl. ..... 439/852

[58] Field of Search ..... 439/842–862, 439/252

[56] References Cited

U.S. PATENT DOCUMENTS

| | | | |
|---|---|---|---|
| 3,363,224 | 1/1968 | Gluntz | 439/852 |
| 4,076,369 | 2/1978 | Ostapovitch | 439/852 |
| 4,874,338 | 10/1989 | Bakermans | 439/851 |

FOREIGN PATENT DOCUMENTS

| | | | |
|---|---|---|---|
| 2613878 | 10/1988 | France | 439/851 |

*Primary Examiner*—Gary F. Paumen
*Assistant Examiner*—Brian J. Biggi

[57] ABSTRACT

An electrical receptacle comprises a longitudinally supple intermediate section and a contact section. The contact section has a box-shape formed by side walls and top and bottom walls, where cantilever beam contact arms extend from opposing side walls and are attached proximate a mating end. Free ends of the contact arms bias against tabs that extend from the top and bottom walls. The top and bottom walls comprise spring beams that provide the main spring force for the contacts. The arrangement of the contacts and spring beams uses material effectively and enables easy manufacturing for miniature contacts. High contact forces are nevertheless achieved.

7 Claims, 1 Drawing Sheet

ELECTRICAL RECEPTACLE TERMINAL

BACKGROUND OF THE INVENTION

1. Field of the Invention

This invention relates to an electrical receptacle terminal for mating with a complementary tab, the receptacle terminal particularly suited for miniature or compact arrangements but high current applications, and also suitable for avoiding fretting corrosion in vibration conditions.

2. Description of the Prior Art

In certain applications, such as in the automotive industry, electrical terminals are subject to high mechanical and thermal solicitation, yet must carry high electrical currents in a reliable manner over the lifetime of the contact. Furthermore, continuing miniaturization of the electrical and electronic components often requires more compact electrical connectors and therefore electrical terminals. The large number of electrical functions sometimes supplied through a single electrical connector, often entails high mating forces when coupling complementary connectors. It is however desirable to reduce mating forces to reasonable levels appropriate for manual operation. This is however a conflicting requirement to the desire of carrying high electrical current which requires a high contact force between mating terminals. Furthermore, it is a continuing requirement to provide reliable connectors that are also cost-effective.

SUMMARY OF THE INVENTION

It is an object of this invention to provide an electrical receptacle terminal that is capable of carrying high currents, but has low mating forces, in a compact and cost-effective design.

Objects of this invention have been achieved by providing an electrical receptacle terminal comprising a connection section, an intermediate section and a contact section for mating with a complementary tab or pin terminal, the contact section extending between the intermediate section and a mating end where the complementary terminal is received, the contact section comprising a pair of opposed side walls and a bottom and top wall forming a substantially box-shape, and a pair of contacts extending from each side wall proximate the mating end towards free ends of the contact arms proximate the intermediate section, the top and bottom walls comprising spring beams extending in a plane substantially orthogonal to the side walls and interconnected proximate the mating end to the contacts thereby providing spring support for the contacts. In an advantageous embodiment, the side walls are provided with tabs proximate the contact free ends, the tabs overlapping a portion of the contacts for supporting the contact free ends when resiliently biased outwards upon insertion of a complementary tab between the contacts. The contacts may comprise arcuate contact sections projecting towards each other and separated by a gap for decreasing the insertion force of a complementary tab therebetween.

DETAILED DESCRIPTION OF THE PREFERRED EMBODIMENT

Figures 1, 2, 3, 4:
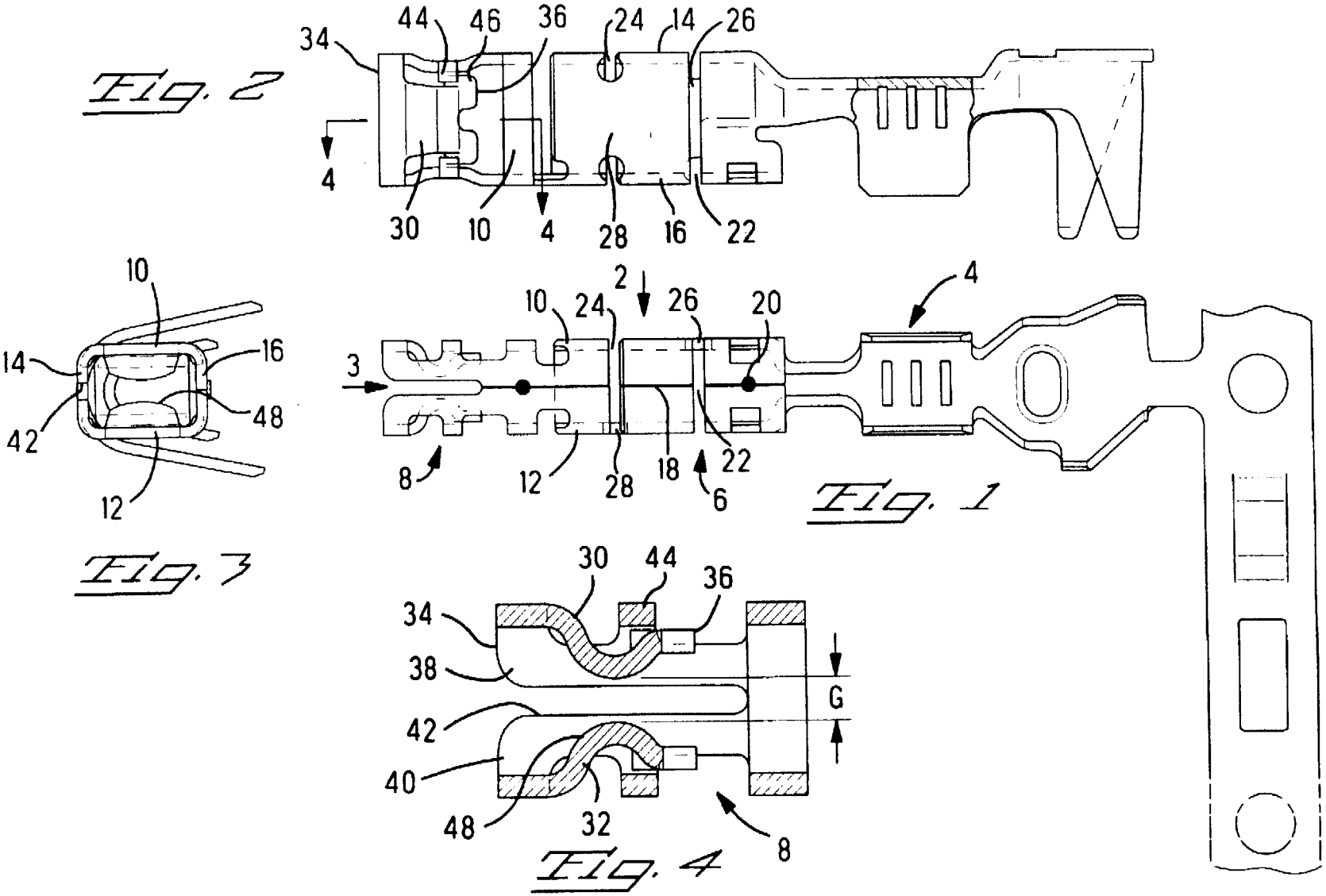
FIG. 1 is a top view of a receptacle terminal according to this invention.
FIG. 2 is a view in the direction of arrow 2 of FIG. 1.
FIG. 3 is a view in the direction of arrow 3 of FIG. 1.
FIG. 4 is a cross-sectional view through lines 4—4 of FIG. 2.

Referring to FIGS. 1 and 2, an electrical receptacle terminal 2 is stamped and formed from sheet metal and comprises a connection section 4 for crimping to a conducting wire, an intermediate section 6, and a contact section 8 for mating with a complementary tab terminal (not shown). The intermediate and contact sections comprise opposed side walls 10,12 and opposed top and bottom walls 14,16 so as to form a box-shape. The connection section 4 extends substantially from the base and side walls, and the top wall comprises a seam 18 resulting from the folding together of the sheet metal. The seam 18 is held together by welds 20 (but other fixing means could be imagined) which enable provision of a compact design.

The intermediate section 6 comprises a pair of slots 22,24 that extend from opposing side walls 12,10 respectively, the slots being spaced longitudinally apart (where the longitudinal direction is the direction of insertion of a complementary tab terminal in the receptacle terminal). The slots traverse substantially the whole box shape to the opposing side wall where a portion 26,28 respectively remains intact. Flexing about the portions 26,28 enable the intermediate section to be very flexible in the longitudinal direction such that vibrational forces between the contact section 8 and connection section 4 are absorbed thereby preventing fretting corrosion between the contact section and a complementary tab terminal. To ensure the latter, the contact frictional force between the contact section 8 and the complementary tab terminal must be greater than the spring force of the intermediate section.

Referring to FIG. 4, the contact section 8 comprises a pair of cantilever beam contact arms 30,32 each extending from a side wall 10,12 and attached to the side wall proximate a mating end 34 of the terminal. The contact arms extend therefrom towards free ends 36 proximate the intermediate section 6. The top and bottom wall comprise each a pair of spring beams 38,40. The spring beams are within the planes of the top and bottom walls where spring beams 38 are attached proximate the mating end 34 to the contact arm 30 and spring beams 40 are attached proximate the mating end 34 to contact arm 32. The pair of spring beams 38 thereby flank one of the contact arms and the other spring beams flank the other contact arm providing spring support thereto. Due to the position of the spring beams in a plane substantially parallel to the outward biasing direction of the contacts, a high spring force is achieved. The spring beams 38,40 are separated by a slot 42 that extends from the mating end 34 to the intermediate section 6.

Proximate the free ends 36 of the contacts 32, are tabs 44 extending from the spring beams 38,40 orthogonally thereto and overlapping a laterally widened portion 46 of the contact arms. Outward biasing of the contacts 30,32 thus causes abutment of the free end portion 36 with the tabs 44 to find support thereagainst. The main spring effect is subsequently taken up by the lateral spring beams 38,40 for high spring force. The contacts 30,32 comprise arcuate contact protrusions 48 directed towards each other and separated by a gap G that is smaller than the width of the complementary tab terminal. Forming of the protrusions 48 shortens the distance between the free end portion 36 and the mating end 34 thereby allowing the widened end portion 46 to be brought to the level of tabs 44. An outer body (not shown) can be positioned over the intermediate and contact sections of the terminal 2 for protection and support thereof in a connector cavity. Such an outer body would be attached to the terminal proximate the connection section to enable floating movement of the contact section 8.

The tabs 44 and contacts can be stamped from the side walls thereby ensuring low material usage for a cost-effective design. The separation of the free ends 36 of the contacts increases the flexibility of the contact sections as they are allowed to expand longitudinally.

The relatively clean outer box-shape and effective material usage of the side and top walls, enables the contact to be easily manufactured in miniature form whilst providing high contact force due to the spring beams in the plane of outward biasing, yet reasonably low mating forces due to the gap separating contact sections.

I claim:

1. An electrical receptacle terminal comprising a connection section, an intermediate section and a contact section for mating with a complementary tab or pin contact, the contact section extending from a mating end to the intermediate section and having side walls and top and bottom walls, the contact section comprising a pair of contact arms extending from opposing side walls respectively and having contact protrusions, characterized in that the top and bottom walls comprise spring beams substantially planar with the top and bottom walls and joined to the contact arms at an attachment portion proximate the mating end for providing resiliency to the contact arms, the contact arms extending therefrom towards free ends detached from the side walls and proximate the intermediate section, the contact arms being formed from the portion of the side walls between the intermediate section and mating end, and wherein the spring beams attached respectively to each contact arm are separated by a slot extending from the mating end to the intermediate section.

2. The terminal of claim 1 wherein tabs extend from the spring beams proximate the contact arm free ends, the tabs overlapping a portion of the free ends for biasing of the contact free ends thereagainst when mating with the complementary tab or pin contact.

3. The terminal of claim 2 wherein the contact arm free ends comprise widened portions extending towards the top and bottom walls respectively, for overlapping with the tabs.

4. The terminal of claim 3 wherein the top and bottom walls are bowed towards each other at the position of the tabs to overlap the tabs with the contact arm free ends.

5. The terminal of claim 4 wherein the contact protrusions are separated by a gap to reduce mating forces.

6. The terminal of claim 1 wherein the intermediate section is adapted to be resilient and supple in the direction of mating of the complementary tab.

7. The terminal of claim 6 wherein the intermediate section has a generally box-shape formed by the side walls and top and bottom walls, and is supple in the direction of mating of the complementary tab by provision of slots extending transversely to the mating direction and from opposing sides of the box-shape, the slots traversing most of the box-shape of the intermediate section.

* * * * *